US008628233B2

(12) United States Patent
Schöchlin

(10) Patent No.: US 8,628,233 B2
(45) Date of Patent: Jan. 14, 2014

(54) FLOW CHANNEL FOR A MIXER HEAT EXCHANGER

(75) Inventor: Martin Schöchlin, Winterthur (CH)

(73) Assignee: Atlas Holding AG, Hettlingen (CH)

( * ) Notice: Subject to any disclaimer, the term of this patent is extended or adjusted under 35 U.S.C. 154(b) by 987 days.

(21) Appl. No.: 12/601,119

(22) PCT Filed: May 20, 2008

(86) PCT No.: PCT/CH2008/000226
§ 371 (c)(1),
(2), (4) Date: Mar. 3, 2010

(87) PCT Pub. No.: WO2008/141472
PCT Pub. Date: Nov. 27, 2008

(65) Prior Publication Data

US 2010/0163216 A1 Jul. 1, 2010

(30) Foreign Application Priority Data

May 24, 2007 (EP) ..... 07405151

(51) Int. Cl.
*B01F 5/06* (2006.01)

(52) U.S. Cl.
USPC ..... 366/337; 165/109.1

(58) Field of Classification Search
USPC ..... 366/181.5, 336–340; 48/189.4; 138/37, 138/39, 40, 42; 222/145.6; 165/109.1, 179
See application file for complete search history.

(56) References Cited

U.S. PATENT DOCUMENTS

| | | | | |
|---|---|---|---|---|
| 1,496,345 | A * | 6/1924 | Lichtenthaeler | 366/165.2 |
| 2,784,948 | A * | 3/1957 | Pahl et al. | 366/174.1 |
| 3,190,618 | A * | 6/1965 | Katzen | 366/337 |
| 3,743,250 | A * | 7/1973 | Fitzhugh et al. | 366/337 |
| 4,211,277 | A | 7/1980 | Grosz-Roll et al. | |
| 6,102,561 | A * | 8/2000 | King | 366/181.5 |
| 6,595,679 | B2 * | 7/2003 | Schuchardt | 366/147 |
| 7,077,561 | B2 * | 7/2006 | Streiff et al. | 366/337 |
| 8,491,180 | B2 * | 7/2013 | Hirschberg et al. | 366/337 |
| 2001/0012235 | A1 * | 8/2001 | Schuchardt | 366/337 |
| 2004/0085853 | A1 * | 5/2004 | Kohlgruber et al. | 366/147 |
| 2004/0125691 | A1 * | 7/2004 | Streiff et al. | 366/337 |

FOREIGN PATENT DOCUMENTS

| | | | |
|---|---|---|---|
| DE | 2808854 | A1 | 1/1979 |
| DE | 8019476 | U1 | 3/1981 |
| DE | 10359565 | A1 | 7/2005 |
| EP | 1067352 | A1 | 1/2001 |
| EP | 1123730 | A2 | 8/2001 |

* cited by examiner

*Primary Examiner* — Charles E Cooley
(74) *Attorney, Agent, or Firm* — The Webb Law Firm

(57) ABSTRACT

The invention relates to a flow channel having a mixing insert and a plurality of tubes guided parallel to the longitudinal axis of the flow channel over the length of the mixing insert, each mixing insert including at least twenty-eight pairwise crossed multi-wall sheets, the ratio of the width of the multi-wall sheets to the inside diameter of the flow channel being no more than 0.25, the ratio of the length of the mixing insert to the inside diameter of the flow channel being no less than 0.4, and the angle of the multi-wall sheets to the longitudinal axis of the flow channel being 30° to 60° and the ratio of the intermediate spacing of neighboring planes to the inside diameter of the flow channel being no more than 0.3, and to the inside diameter of the tubes being less than 6.

10 Claims, 5 Drawing Sheets

FLOW CHANNEL FOR A MIXER HEAT EXCHANGER

BACKGROUND OF THE INVENTION

1. Field of the Invention

The invention relates to a flow channel for a mixer heat exchanger, which flow channel is of tubular design with a longitudinal axis and with an inner surface area of circular cross section with an inside diameter and having at least one mixing insert of a length, with a multiplicity of tubes guided parallel to the longitudinal axis of the flow channel over the length of the mixing insert and having an inside diameter and with a multiplicity of crosswise arranged web plates of a width, forming with the longitudinal axis of the flow channel an angle, the web plates being arranged in two mutually intersecting plane groups having a multiplicity of parallel planes with a mutual spacing, and a third plane group, which has a multiplicity of parallel planes with a mutual spacing corresponding to the width of the web plates, intersecting the two mutually intersecting plane groups at right angles, the intersection lines of the planes of the two mutually intersecting plane groups forming, with the planes of the third plane group, longitudinal edges of the web plates arranged between adjacent planes of the third plane group alternately in the planes of the two mutually intersecting plane groups, the tubes being led through orifices in the web plates and being fastened to the web plates.

2. Description of Related Art

DE 28 08 854 C3 discloses a flow channel, designated as a "static mixer" according to conventional linguistic use, for heat exchange, with fittings consisting of parallel groups of mutually intersecting webs connected to one another at their intersection points. This device mainly mixes the substance stream. The deflection of the substance streams brings about an improvement in heat transfer at the tube wall. However, the double-casing design becomes very long, and the pressure loss is correspondingly high.

A flow channel of the type initially mentioned is known from EP 1 067 352 B1.

SUMMARY OF THE INVENTION

The object on which the invention is based is to provide a flow channel of the type initially mentioned, which, particularly in the case of high-viscosity fluids, leads to an appreciable improvement in heat exchange and makes it possible to build a compact heat exchanger.

The object is achieved, according to the invention, in that each mixing insert has at least twenty eight web plates crossed in pairs, the ratio of the web width to the inside diameter of the flow channel amounts to at most 0.25, the ratio of the length of the mixing insert to the inside diameter of the flow channel amounts to at least 0.4 and the angle of the web plates to the longitudinal axis of the flow channel amounts to 30° to 60°, and the ratio of the spacing between adjacent planes of the mutually intersecting plane groups having the web plates to the inside diameter of the flow channel amounts to at most 0.3 and to the inside diameter of the tubes amounts to less than 6.

Preferably, the ratio of the spacing between adjacent planes of the mutually intersecting plane groups having the web plates to the inside diameter of the tubes amounts to less than 4, in particular to less than 3.

In the device known from EP 1 067 352 B1 and put on the market, for manufacturing reasons the web plates have an angle of 45°, and the ratio of the defined vertical web spacing between two adjacent web plates to the tube diameter is 0.3 to 0.35. In processing engineering tests, these geometries have proved to be extraordinarily successful and are employed increasingly in high-tech processes.

Since, in heat exchangers, a scale-up with a geometrically similar apparatus always results in a poorer surface/volume ratio, the surface/volume ratio has to be improved by means of additional surface, in the present invention by means of additional tubes.

However, it can be clearly seen from FIG. 4 that, with an increasing number of tubes, the Nusselt number decreases, and therefore no or only slight additional heat transfer is achieved by means of additional tubes.

For this reason, according to the invention, additional web plates are employed in order to improve the heat transmission. With the rise in the number of web plates, the ratio of the defined vertical web spacing between two adjacent web plates to the inside diameter of the flow channel also decreases. This additional measure leads to heat transmission which is improved by up to 60%.

The Nusselt number mentioned (formula symbol: Nu, according to Wilhelm Nusselt) is a dimensionless characteristic number from the similarity theory of heat transmission, which measures the improvement in the heat transmission of a surface when the actual ratios are compared with the ratios at which only heat conduction through a stationary layer would occur.

Surprisingly, when the ratio of the above-defined web spacing to the inside diameter of the tubes undershoots a specific value, a hitherto inexplicable further improvement in heat transmission occurs. This phenomenon can be seen from FIG. 5.

The crosswise arranged web plates may have a different angle to the longitudinal axis of the flow channel. However, an identical angle is preferred.

The planes of the two mutually intersecting plane groups may have different mutual spacings. However, an identical mutual spacing is preferred.

The planes of the two mutually intersecting plane groups may have a slight curvature in the longitudinal axis of the flow channel.

The planes of the third plane group may have a different mutual spacing, that is to say the web plates may be of different width. However, an identical mutual spacing of the planes and, correspondingly, an identical width of all web plates are preferred.

Preferably, the mixing inserts are arranged one behind the other in the flow channel, the mutually contiguous mixing inserts being rotated at an angle of 90° about the longitudinal axis of the flow channel with respect to one another.

The freely positionable tubes may be soldered or welded to the web plates, or the web plates may be shrunk onto the tubes.

If the flow channel according to the invention is used as a mixer, a second component can be admixed via at least one tube with at least one hole for fluid outflow, preferably via a plurality of tubes with a plurality of holes, to a component flowing in the flow channel.

A plurality of mixing inserts may be arranged in the flow channel one behind the other with spacings corresponding at most to three times the length of a mixing insert, the mixing inserts being rotated at an angle of 90° with respect to one another according to the spacings.

The flow channel according to the invention is suitable as a static mixer.

BRIEF DESCRIPTION OF THE DRAWINGS

Further advantages, features and details may be gathered from the following description of an exemplary embodiment and with reference to the drawing in which.

DETAILED DESCRIPTION OF THE PREFERRED EMBODIMENTS

Figure 1:
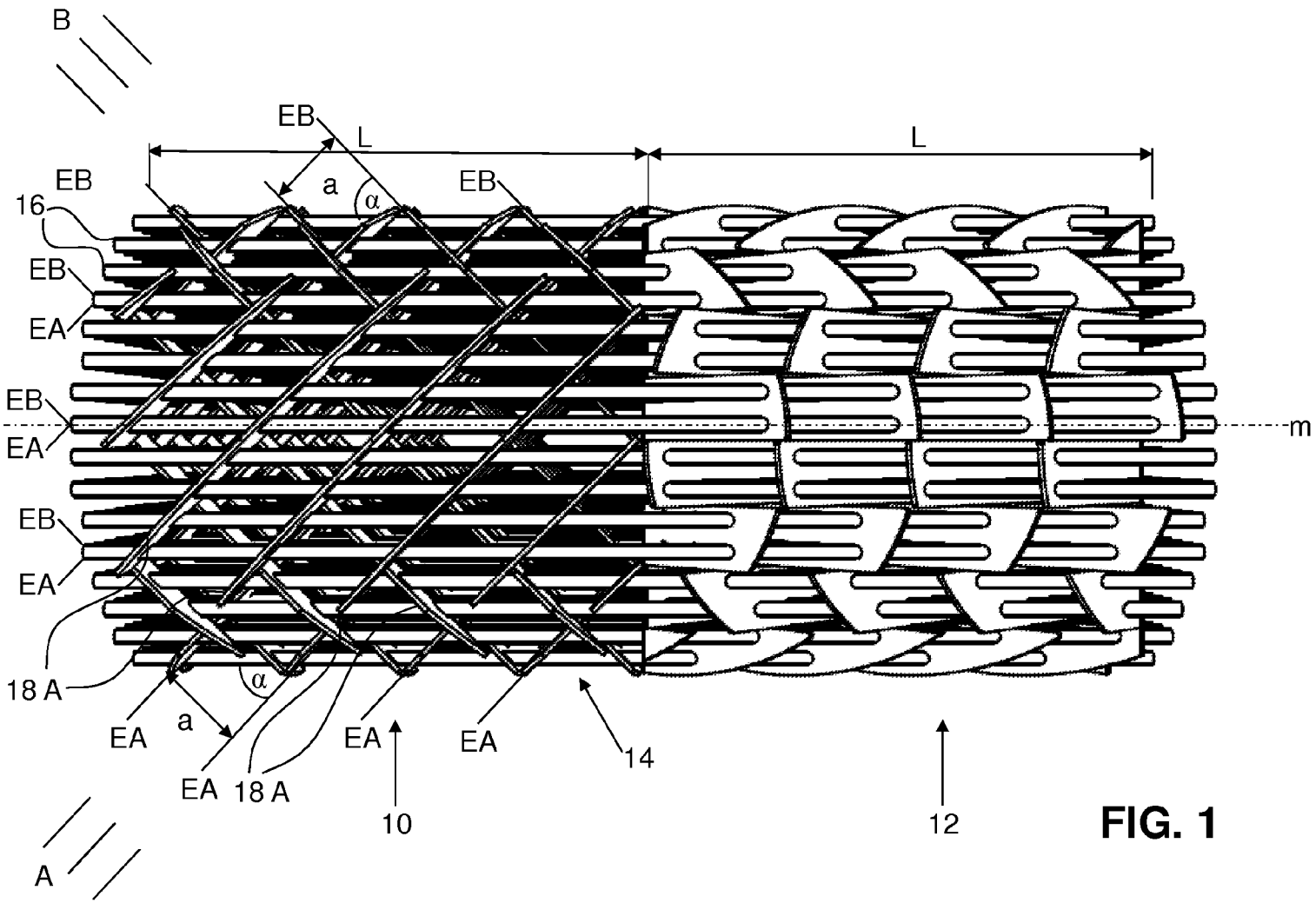
FIG. 1 shows a side view of two mutually contiguous mixing inserts for a flow channel.
Figure 2:
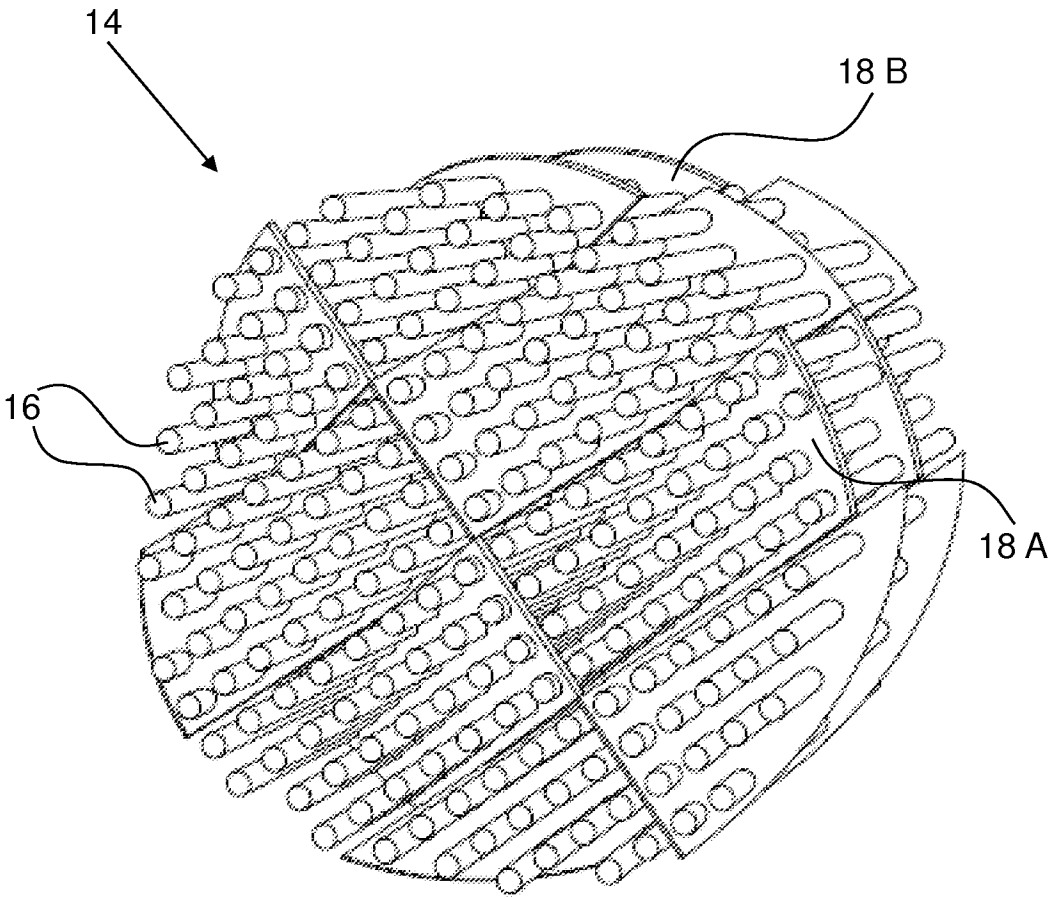
FIG. 2 shows an oblique view of a mixing insert.

Two mixing inserts 10, 12, shown in FIG. 1, contiguous to one another along their longitudinal axis m and having a length L, for media flowing in a flow channel have, according to FIG. 2, a tube bundle 14 with 188 tubes 16 arranged parallel to the longitudinal axis m and extending over the entire length L. Each mixing insert 10, 12 has a multiplicity of mutually intersecting web plates 18A, 18B. The web plates 18A, 18B all have the same width b and lie in planes EA, EB which are arranged parallel to one another with the same mutual spacing a and which form two mutually intersecting plane groups A, B. The planes EA of the plane group A form with the longitudinal axis m in each case an identical angle αA, αB of 45°.

Planes EC of a third plane group C, which are arranged parallel to one another with a mutual spacing b corresponding to the width b of the web plates 18A, 18B run parallel to the longitudinal axis m and intersect the planes EA, EB of the two mutually intersecting plane groups A, B at right angles. In this case, the intersection lines of the planes EA, EB of the two mutually intersecting plane groups A, B form with the planes EC of the third plane group C longitudinal edges 20A, 20B of the web plates 18A, 18B arranged between adjacent planes EC alternately in the planes EA, EB of the two mutually intersecting plane groups A, B.

As shown in FIG. 1, the mutually contiguous mixing inserts 10, 12 are arranged rotated at an angle of 90° about their longitudinal axis m with respect to one another.

Figure 3:
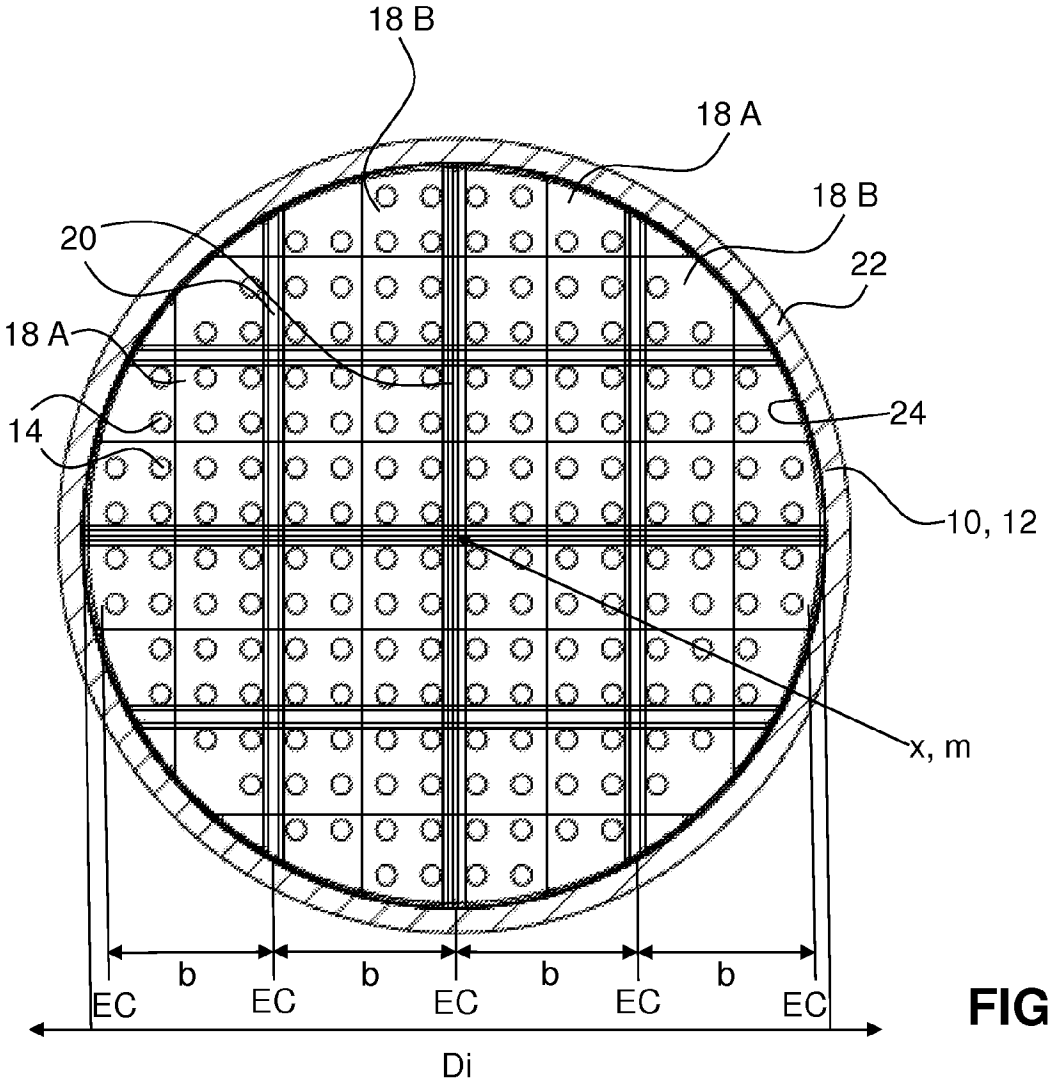
FIG. 3 shows a view of a mixing insert in a flow channel as viewed in a direction of the longitudinal axis of the flow channel.
Figure 4:
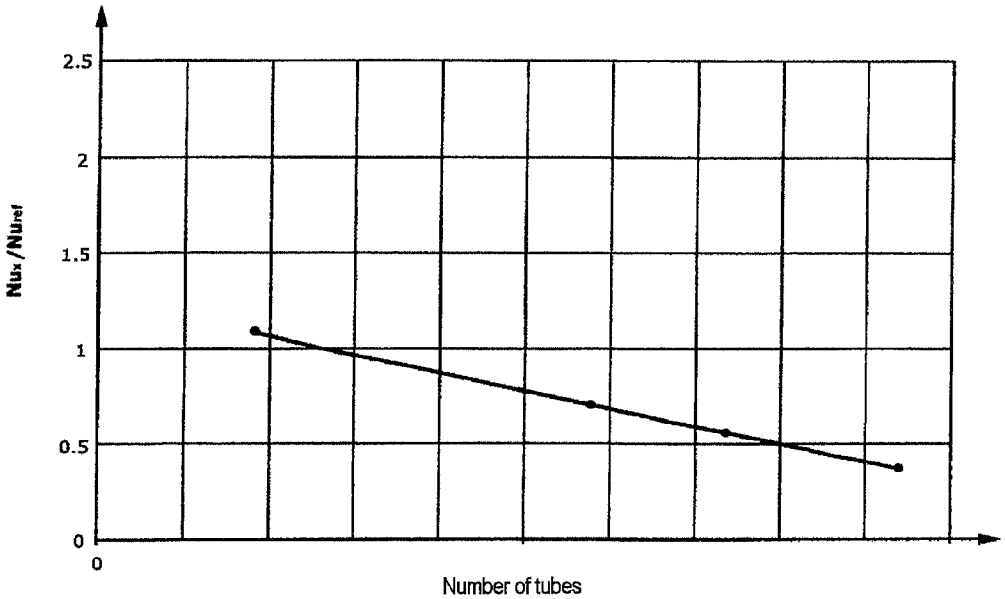
FIG. 4 shows the Nusselt number as a function of the number of tubes in a flow channel.

In FIG. 3, the mixing inserts 10, 12 rotated at an angle of 90° about their longitudinal axis m with respect to one another are arranged in a tubular flow channel 22 with an inner surface area 24 of circular cross section, with an inside diameter Di and with a tube or flow channel longitudinal axis x. In this case, the longitudinal axes m of the mixing inserts 10, 12 lie in the longitudinal axis x of the flow channel 22.

All the web plates 18A, 18B extend, within each mixing insert 10, 12, in each case over their maximum possible length limited by the end faces of the mixing inserts 10, 12 and by the inner wall of the flow channel, the contour of the web plates 18A, 18B being adjusted to the circular cross section of the flow channel 22 such that the web plates 18A, 18B are contiguous to the inner surface area 24 of the flow channel 22 with slight play.

As shown in FIG. 2, the tubes 16 pass through the web plates 18A, 18B via orifices which are arranged in these and which have an elliptic boundary according to the angle between the web plate 18A, 18B and tube 16. The tubes 16 are fastened to the web plates 18A, 18B in the region of the orifices via a soldered or welded joint. The web plates 18A, 18B are likewise connected to one another at their intersection points via soldered or welded points.

In the assembly of a mixer heat exchanger, the individual mixing inserts 10, 12 are prefabricated by means of the crossed arrangement of the corresponding number of web plates 18A, 18B. The prefabricated mixing inserts 10, 12 are lined up with one another, rotated by 90° with respect to one another, along their longitudinal axis m. The tubes 16 are subsequently pushed, parallel to the longitudinal axis m, through the orifices in the web plates 18A, 18B and fastened to these. The insert part manufactured in this way is then pushed into the flow channel.

Figure 5:
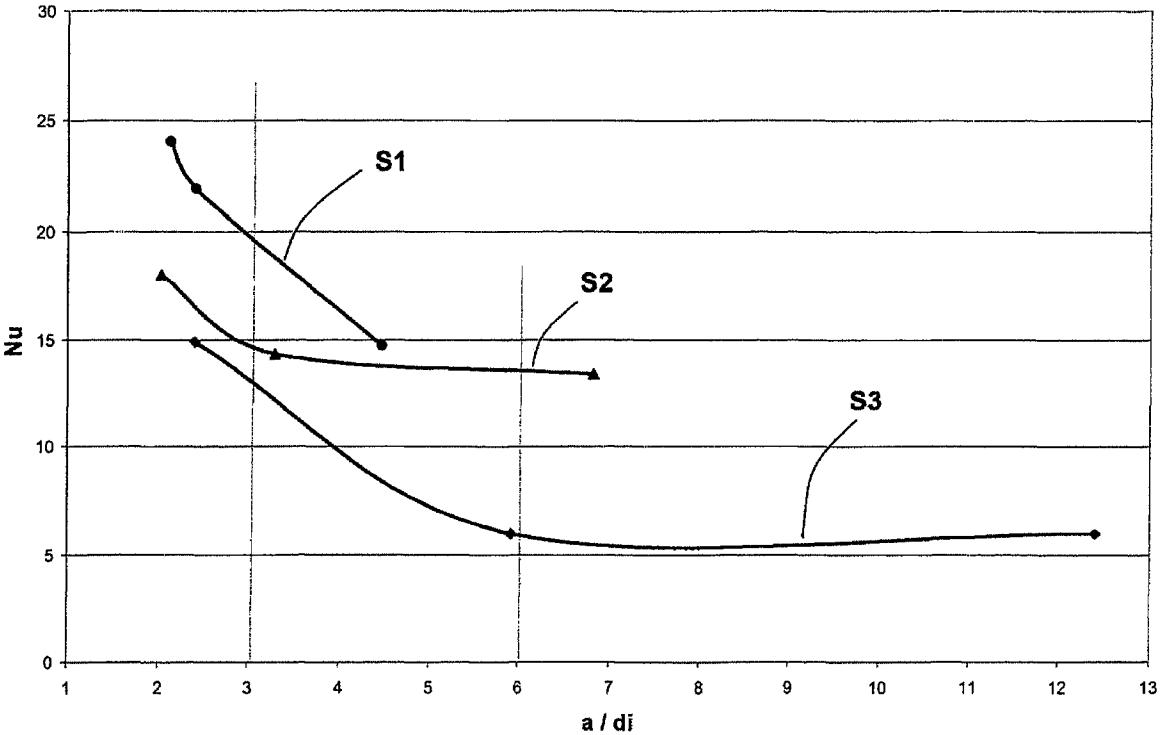
FIG. 5 shows the Nusselt number as a function of the ratio of the web spacing to the tube inside diameter.

FIG. 5 illustrates graphically the results of measurements of heat transmission on three differently constructed flow channels S1, S2, S3 as the Nusselt number (Nu) as a function of the web spacing (a)/tube inside diameter (di) ratio in the case of a constant reference Peclet number ($Pe_{ref}$). The construction of the flow channels S1, S2, S3 can be seen from the following table.

TABLE

Construction of the tested flow channels

| Flow channel | S1 | S2 | S3 |
|---|---|---|---|
| Inside diameter (Di) of the flow channel [mm] | 145 | 279.3 | 358 |
| Number of tubes | 52 | 180 | 180 |
| Inside diameter (di) of the tubes [mm] | 10 | 10 | 10 |

The web spacing (a) is obtained from the measured values of the web spacing (a)/tube inside diameter (di) ratio in FIG. 5. The surprising effect that heat transmission suddenly rises unexpectedly when a specific ratio is undershot is clearly evident from FIG. 5.

The invention claimed is:

1. A flow channel for a mixer heat exchanger, which flow channel is of tubular design with a longitudinal axis and with an inner surface area of circular cross section with an inside diameter and having at least one mixing insert of a length with a multiplicity of tubes guided parallel to the longitudinal axis of the flow channel over the length of the mixing insert and having an inside diameter having a multiplicity of crosswise arranged web plates of a width which forms with the longitudinal axis of the flow channel an angle, the web plates being arranged in two mutually intersecting plane groups having a multiplicity of parallel planes with a mutual spacing, and a third plane group which has a multiplicity of parallel planes with a mutual spacing corresponding to the width of the web plates intersecting the two mutually intersecting plane groups at right angles, the intersection lines of the planes of the two mutually intersecting plane groups forming, with the planes of the third plane group, longitudinal edges of the web plates arranged between adjacent planes of the third plane group alternately in the planes of the two mutually intersecting plane groups, the tubes being led through orifices in the web plates and being fastened to the web plates, wherein each mixing insert has at least twenty eight web plates crossed in pairs, the ratio of the width of the web plates to the inside diameter of the flow channel amounts to at most 0.25, the ratio of the length of the mixing insert to the inside diameter of the flow channel amounts to at least 0.4 and the angle of the web plates to the longitudinal axis of the flow channel amounts to 30° to 60°, and the ratio of the mutual spacing of adjacent planes of the mutually intersecting plane groups having the web plates to the inside diameter of the flow channel amounts to at most 0.3 and to the inside diameter of the tubes amounts to less than 6.

2. The flow channel as claimed in claim 1, wherein the ratio of the mutual spacing of adjacent planes of the mutual intersecting plane groups having the web plates to the inside diameter of the tubes amounts to less than 4.

3. The flow channel as claimed in claim 1, wherein the crosswise arranged web plates have an identical angle to the longitudinal axis of the flow channel.

4. The flow channel as claimed in claim 1, wherein the planes of the two mutually intersecting plane groups have an identical mutual spacing.

5. The flow channel as claimed in claim 1, wherein the planes of the two mutually intersecting plane groups have a slight curvature in the longitudinal axis of the flow channel.

6. The flow channel as claimed in claim 1, wherein the planes to the third plane group have an identical mutual spacing corresponding to the width of the web plates.

7. The flow channel as claimed in claim 1, wherein the mixing inserts are arranged one behind the other in the flow channel, the mutually contiguous mixing inserts being rotated at an angle of 90° about the longitudinal axis of the flow channel with respect to one another.

8. The flow channel as claimed in claim 1, wherein the tubes are freely positionable.

9. The flow channel as claimed in claim 1, wherein at least one tube has at least one hole for fluid outflow.

10. The flow channel as claimed in claim 1, wherein a plurality of mixing inserts are arranged one behind the other in the flow channel with spacings corresponding to at most three times the length of a mixing insert, the mixing inserts being rotated at an angle of 90° with respect to one another according to the spacings.

* * * * *

UNITED STATES PATENT AND TRADEMARK OFFICE

CERTIFICATE OF CORRECTION

PATENT NO. : 8,628,233 B2
APPLICATION NO. : 12/601119
DATED : January 14, 2014
INVENTOR(S) : Martin Schöchlin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1086 days.

Signed and Sealed this
Thirtieth Day of May, 2017

Michelle K. Lee

Michelle K. Lee
*Director of the United States Patent and Trademark Office*